US006299171B1

(12) United States Patent
Mollo et al.

(10) Patent No.: US 6,299,171 B1
(45) Date of Patent: Oct. 9, 2001

(54) METHOD OF PLAYING A BACCARAT-TYPE CARD GAME

(75) Inventors: Paul Thomas Mollo, Brigantine; Peter Joseph Ortiz, Atlantic City, both of NJ (US)

(73) Assignee: Peter & Paul, Inc., Brigantine, NJ (US)

( * ) Notice: Subject to any disclaimer, the term of this patent is extended or adjusted under 35 U.S.C. 154(b) by 0 days.

(21) Appl. No.: 09/399,101

(22) Filed: Sep. 20, 1999

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS

| | | | |
|---|---|---|---|
| 4,659,087 | | 4/1987 | Shen et al. . |
| 5,013,049 | | 5/1991 | Tomaszewski . |
| 5,257,810 | | 11/1993 | Schorr et al. . |
| 5,275,416 | | 1/1994 | Schorr et al. . |
| 5,320,356 | | 6/1994 | Cauda . |
| 5,328,189 | | 7/1994 | Malek . |
| 5,362,064 | | 11/1994 | Lofink et al. . |
| 5,366,228 | | 11/1994 | Kangsanaraks . |
| 5,395,119 | | 3/1995 | Jacob et al. . |
| 5,397,128 | | 3/1995 | Hesse et al. . |
| 5,476,265 | | 12/1995 | Miller et al. . |
| 5,496,038 | | 3/1996 | Kangsanaraks . |
| 5,529,309 | | 6/1996 | Bartlett . |
| 5,653,445 | * | 8/1997 | Quach ..... 273/292 |
| 5,690,335 | | 11/1997 | Skratulia . |
| 5,702,104 | | 12/1997 | Malek et al. . |
| 5,758,878 | | 6/1998 | Brown . |
| 5,772,211 | | 6/1998 | Nazaryan et al. . |

OTHER PUBLICATIONS

Gambling Times Presents The Gambling Connection/Basics of . . . Baccarat http://www.gamblingtimes.com/basbacca.html Sep. 17, 1999 4:41 p.m.
Rules of Card Games: Baccarat http://www.pagat.com/banking/baccarat. html Sep. 17, 1999 4:40 p.m.
Miscellaneous Frequently Asked Questions http:/www.conjelco.com/faq/misc.html Sep. 17, 1999 4:41 p.m.

* cited by examiner

*Primary Examiner*—Benjamin H. Layno
(74) *Attorney, Agent, or Firm*—Hogan & Hartson LLP

(57) ABSTRACT

A method of playing an improved baccarat-type card game wherein unlike conventional baccarat, in the card game each player is dealt his or her own hand of cards, and each player wagers on either a banker's hand to win, or on the player's own hand to win, or on a tie between the player's own hand and the banker's hand. The card game includes the standard baccarat rules of assigning a predetermined value to each card within a standard deck of cards, with an ace through "9" of each suit having values of one through nine respectively and all "10"s and face cards of each suit having a value of zero, and truncating the tens digit to obtain a zero through nine value sum for the player's scores and the banker's score. Unlike conventional baccarat, in the card game a score of ten os awarded to the player's hand or the banker's hand if either contains a combination of any three face cards. Awarding a winning status to an individual player when the player's score exceeds the banker's score, awarding the winning status to the banker's score when the banker's score exceeds the player's score, and awarding a tie if the player's score equals the banker's score.

10 Claims, 3 Drawing Sheets

METHOD OF PLAYING A BACCARAT-TYPE CARD GAME

BACKGROUND OF THE INVENTION

1. Field of the Invention

The present invention relates to a new and improved card game and more particularly, to a new and improved baccarat-type card game having a high level of player interaction, excitement, and game efficiency.

2. Description of Background Art

Card games played with a standard deck of cards are a popular form of amusement. Card games typically do not require expensive or complicated equipment, and provide a wide variety of gaming options. When wagering is involved, card games can offer a more intense and potentially rewarding form of entertainment. Various card games exist that are designed for wagering play.

One such type of card game is baccarat. The goal in baccarat is to obtain a card hand of two or three cards with a combined value ("point count") of nine (the highest hand possible). The baccarat values of the cards in a standard deck of cards are as follows: an ace is one, cards "2" through "9" have a corresponding value of two through nine, and "10s " and face cards have a value of zero. The values of the cards in a hand are added together. If the total value results in a number having a tens digit, the tens digit is truncated, and the one's digit is left as the score. For example, for a hand containing a queen, a"3," and an "8," the score would be 0+3+8=11, or one.

At the start of a game, each player must place a wager on the future outcome. The players must wager on whether the banker's hand will win or the player's hand will win. A player will receive an even payoff if he or she correctly wagered on the winner, and will lose the wager otherwise. However, if a player wins a wager on the banker's hand, the player must pay a commission or "vigorish" to the gaming establishment (no commission is due if the player wins the wager on the player's hand). The typical baccarat commission is five percent of the player's winning wager. This commission is what makes the baccarat game profitable for the gaming establishment.

After the wagers have been placed, two cards each are dealt as the banker's hand and as a general player hand representing all players. Elaborate rules exist called "third card draw" rules, wherein the banker's hand, the player hand, or both, are required to draw a third card based on the values of the two card hands.

Typically, the baccarat third card draw rules are mandatory, and are as follows. If the initial two card player hand has a point total of 0, 1, 2, 3, 4 or 5, the player hand must draw a third card. If the initial two card player hand has a point total of 6–9, the player hand stands and does not receive a third card.

If the player hand stands and does not draw a third card, then the bank hand follows the draw rule above.

If the player hand draws a third card, then the bank hand must draw or stand as follows. If the bank hand two card point total is 0–2, the bank must always draw. If the bank hand two card point total is 3, then the bank hand must draw when the player hand's third card is 0–7 or 9, and the bank must stand if the player hand third card is 8. If the bank hand two card point total is 4, then the bank hand must draw when the player hand's third card is 2–7, and the bank must stand if the player hand's third card is 0, 1, 8 or 9. If the bank hand two card point total is 5, then the bank hand must draw when the player hand's third card is 4–7, and the bank must stand if the player hand's third card is 0–3, 8 or 9. If the bank hand two card point total is 6, then the bank hand must draw when the player hand's third card is 6 or 7, and the bank must stand if the player hand's third card is 0–5, 8 or 9. If the bank hand two card point total is 7–9, then the bank always stands. As can be imagined from the above rules, baccarat may be intimidating to inexperienced players.

After the draw is finished, the winner of the round is determined by adding up the total value of the banker's hand and the player hand. The banker's hand and the player hand are summed to produce a single-digit zero through nine value as previously described. The higher of the banker's score and the player score is the winner, although a tie can occur. After the winner is determined, the wagers are paid or collected, and the commission due from any player who placed a winning wager on the banker's hand is recorded. Typically, the commission is not subtracted from the winnings at the time they are given to the winning player, but are marked down and accounted for at a later time.

The commission is charged as a way for the gaming establishment to guarantee profitability. Because the banker's hand, through the third-card draw rules has a higher probability of winning, players could even the odds of the game by consistently wagering on the banker's hand. In response, gaming establishments have traditionally charged a commission on players who wager on the banker's hand and win.

Mini-baccarat is a relatively recent version of baccarat wherein the game is limited to seven players, instead of the fourteen players in traditional baccarat. In addition, the dealer keeps control of the cards throughout the game, and the players are not permitted to deal or handle the cards.

Previous baccarat games have several drawbacks. First, rules regarding the drawing of a third card are numerous and confusing. These rules necessitate a caller, a person conversant with the rules, who determines when a third card can or cannot be drawn. This is discouraging to players, who want to be able to personally know and comprehend the rules.

Second, the commission owed by players who wagered on the banker's hand and lost has traditionally been recorded and periodically collected. At the end of each hand, any commission due the gaming establishment is marked in the commission boxes in the center of the baccarat table. This is additional overhead for the gaming establishment, and creates the possibility of errors. In addition, if a player loses all of his or her money, the commission may be impossible to later collect.

Third, the recording of the commission slows the game down, which has negative consequences when the profit margin of the game is small and profitability depends on the number of hands played during a period of time.

Fourth, no special card combination exists wherein a player may be awarded the highest possible score as a way to add excitement to game play.

Fifth, in traditional baccarat there is one general player hand on which all players make their wagers. This means that all players have a common hand, and all of their fortunes hang on that one hand. There is, therefore, not the excitement of each player having his or her own hand to play independently.

What is needed therefore is a card game that provides more player involvement and excitement, that is less complicated, and is a more efficient and quicker moving game. This can be accomplished in the present invention by, among other things, eliminating the third card draw rules and the commission charged on a winning banker's hand, and employing individual player hands of three cards and a commission collected on the occurrence of a tie between the banker's hand and a player's hand.

SUMMARY OF THE INVENTION

It is therefore an object of the present invention to provide a new and improved card game employing certain traditional features of baccarat and additional new features and methods of play.

It is another object of the invention to provide a new baccarat-type card game in which there are no three card draw rules.

It is yet another object of the invention to provide a new baccarat-type card game in which three cards are dealt to all players and to the banker.

It is a further object of the invention to provide a new baccarat-type card game wherein a commission may be charged when a tie occurs between point count of the banker's hand and that of a player's hand.

It is also an object of the invention to provide a new baccarat-type card game wherein the highest hand possible has a score of ten and is awarded to a hand if the hand contains any combination of three face cards.

It is yet another object of the invention to provide a new baccarat-type card game in which every player will, in turn, be offered the opportunity to bank the game against all other players and the house/dealer, whereby said player shall be responsible for monetary payment and collection of all wagers against all other players and the house/dealer.

It is a further object of the invention to provide a new baccarat-type card game whereby when a select player is banking the game, said player will receive the banker hand and all other players will receive the player hand.

It is yet another object of the invention to provide a new baccarat-type card game in which when a player is banking the game, the house shall always collect a 10% vigorish in the event of a tie between a player hand and the banker hand.

It is an object of the invention to provide a new baccarat-type card game in which when a player is banking the game, the house/dealer shall take and pay all tie wagers.

A method of playing a card game is provided according to a first aspect of the invention. The method comprises the steps of placing wagers on a desired outcome of the card game, assigning a predetermined value to each card within a standard deck of cards, with an ace through "9" of each suit having values of one through nine respectively and "10s" and all face cards having a value of zero, dealing a player's hand to each player and dealing a banker's hand, adding up the assigned card values in each players' hand and in the banker's hand to generate players' scores and a banker's score, truncating the tens digit in the players' scores and in the banker's score to obtain a zero through nine value sum for each player's score and for the banker's score, awarding a score of ten to a player's hand or to the banker's hand if either contains a combination of any three face cards, and awarding a winning status to an individual player's score when the individual player's score exceeds the banker's score, awarding the winning status to the banker's score when the banker's score exceeds the individual player's score, and awarding a tie if a player's score equals the banker's score.

In certain aspects of the subject invention, a commission may be paid from all players in the event of a tie between a player's hand and the banker's hand.

An apparatus for playing a card game is provided according to a second aspect of the invention. The apparatus comprises a standard deck of cards, a game table having a top surface, a plurality of player areas on the top surface of the game table, with each player area having a card region for receiving cards dealt to the player, a tie wager region designated by printing on the surface of the game table, a banker wager region designated by printing on the surface of the game table, and a player wager region designated by printing on the surface of the game table, wherein the players may place wagers on a tie occurrence, a banker hand win, or on a player hand win by placing a wagering chip on the tie wager region, the banker wager region, or the player wager region, and a central dealer area having a card region for receiving cards dealt to a banker.

The above and other objects, features and advantages of the present invention will become clear from the following description of the preferred embodiment thereof, taken in conjunction with the accompanying drawings.

DETAILED DESCRIPTION OF THE PREFERRED EMBODIMENTS

1. Description of Prior Art

Figure 1:
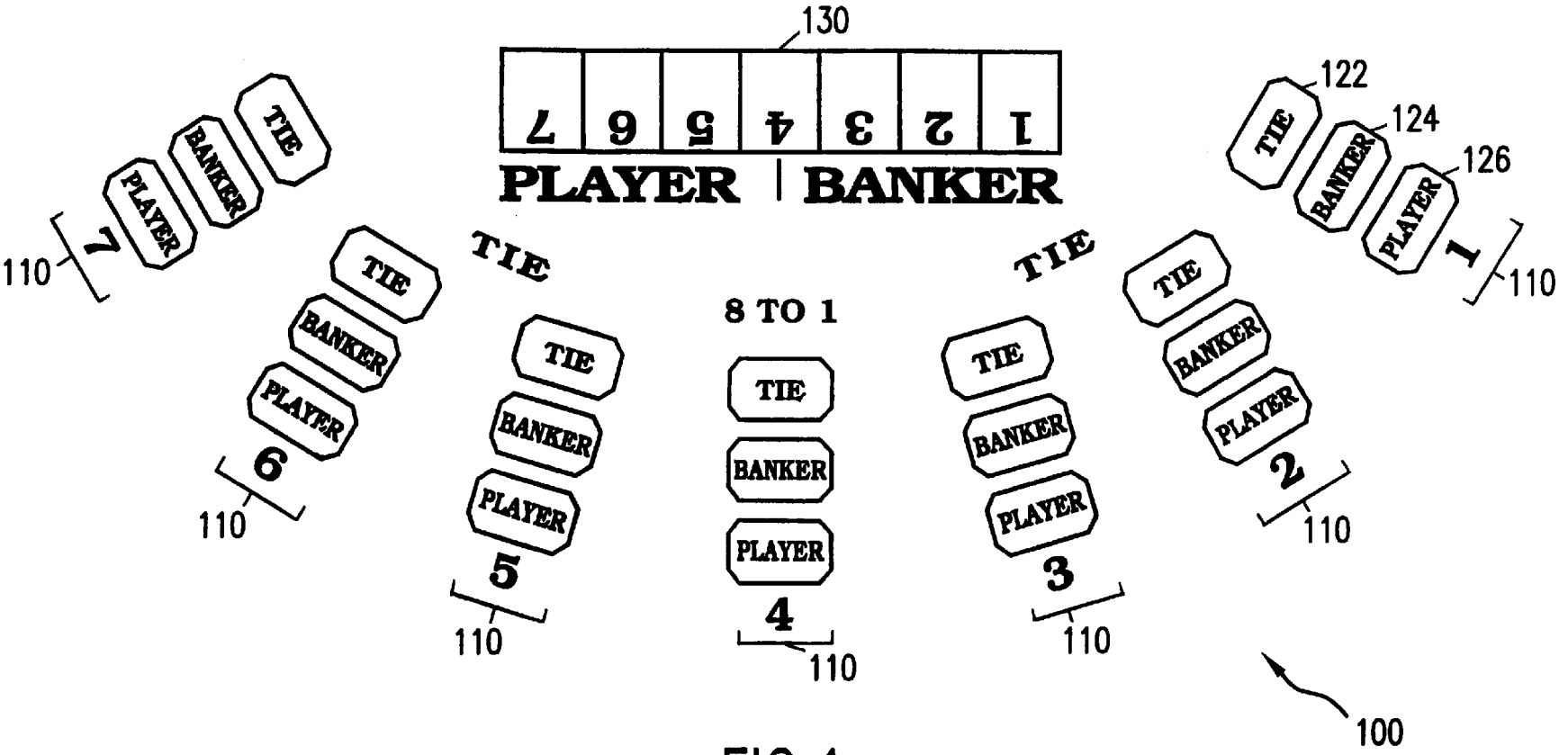
FIG. 1 PRIOR ART
FIG. 1 shows a baccarat table of the prior art.

Referring now to FIG. 1, there is shown a mini-baccarat table 100 of the prior art. Mini-baccarat is a scaled-down version of the baccarat card game. The mini-baccarat table 100 comprises seven player areas 110, with each player area 110 including a tie wager region 122, a banker wager region 124, and a player wager region 126. The mini-baccarat table 100 also includes a commission region 130 where the gaming establishment records the commission owed by each player.

The game starts when each player places a wager. A player can wager on a win by the banker's hand or a win by the player's hand. In play, a banker's hand and a player's hand of two cards each are dealt onto the mini-baccarat table 100. At this point, the third card draw rules come into play, and determine whether the banker's hand or the player's hand may draw a third card (see background for a discussion of the third card draw rules). When both hands are complete, the totals for each hand are computed and the winner is determined.

If a player wagered on the player's hand and the player's hand had a higher score than the banker's hand, then the wager is paid on a one to one payoff (the player receives a payoff equal in amount to the wagered amount). If the player's hand lost, then the player loses the money wagered.

If a player wagered on the banker's hand to win, then the player receives a one to one payoff for a banker's hand win, less a commission. The commission due from each player is recorded by placing an appropriately valued playing chip on the appropriate player number in the commission region 130. At predetermined intervals, the commissions due from the players must be paid to the gaming establishment. Of course, this results in the previously described drawbacks of a slower game, as play must periodically stop for an accounting of commissions. After wagers have been paid, another hand may be dealt.

2. Description of Preferred Embodiment of Present Invention

Figure 2:
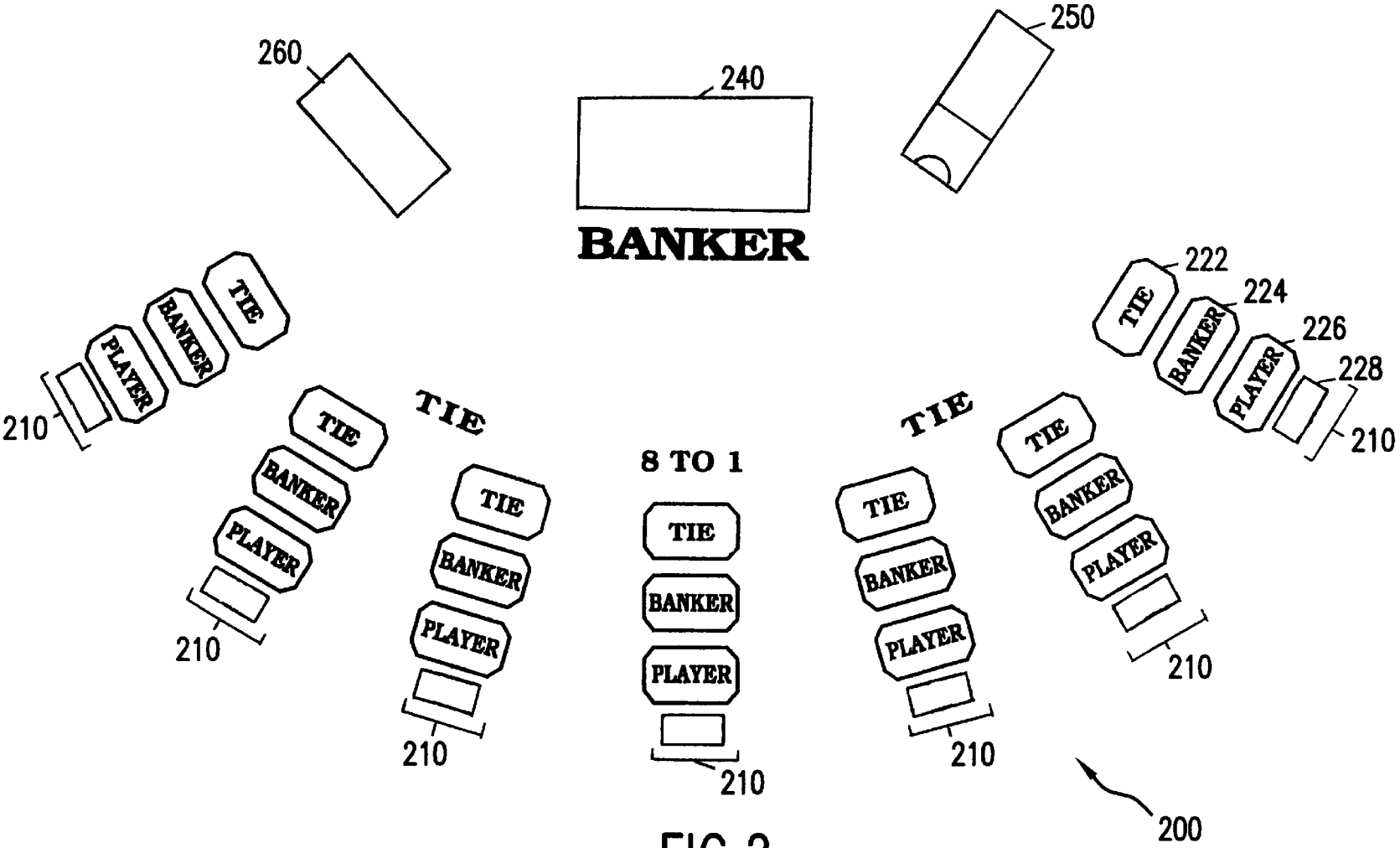
FIG. 2 shows a game table according to the present invention.

FIG. 2 shows a table 200 according to the present invention. The table 200 has seven player areas 210, each comprising a tie wager region 222, a banker wager region 224, and a player wager region 226. The table 200 further includes locations for each player's hand 228, a location for the banker's hand 240, a dealer's shoe region 250, and a discard region 260.

In preparation for the game, one standard deck of fifty-two playing cards is shuffled and placed in the dealer's shoe 250. All cards are dealt from the shoe 250. The game starts when the players place their wagers. Unlike other versions of baccarat, in the card game of the present invention, each player is dealt his or her own hand on which to wager, instead of having one common player's hand. Each player may place a wager on the banker's hand or on his or her own player's hand. In contrast to traditional baccarat, the players may also wager on the likelihood of a tie between their hand and the banker's hand. Because the odds of a tie happening are low, the payoff for a correctly wagered tie is eight to one (a winning player receives a payoff eight times the size of the wagered amount). The wagering is performed by placing playing chips on the appropriate tie wager region 222, banker wager region 224, or player wager region 226 of each player area 210. After the wagers are placed, a dealer deals three cards to the banker's hand 240 and three cards to each player's hand 228. Unlike other versions of baccarat, in the card game of the subject invention, a three card hand is always dealt. There is no draw for additional cards. The dealer turns over the banker's hand first, and then each player turns over his or her hand. The three cards in each hand are totaled to determine the score. The ace through "9" have a value of one through nine, and the "10"s and face cards (jack, queen, and king), have a value of zero. For example, if a hand contains a jack, a "5," and a "7," the score is 0+5+7=12. The tens digit, "1," is truncated, leaving a score of two.

The card game of the present invention adds a new and exciting twist to the score "point count" of a hand. If a player (including the banker) receives a hand containing any combination of three face cards (e.g., jacks, queens and kings), that hand is awarded a score of ten. Ten is the highest possible score, and no other player (or the banker) can beat that score, but may only tie it. Because point values of non-face cards are added and the tens digit is truncated, a card hand having less than three face cards cannot achieve a score of ten. Three face cards, then, is the ultimate or "supreme" hand, and adds an air of anticipation and excitement to the game. Of course, multiple hands of ten will still tie.

After hand scores are calculated, each player's hand is compared in turn to the banker's hand. For each individual player, it must be determined whether that individual player won or lost by examining his or her wager. If the player wagered on a tie and it did not occur, the player loses the wager. If the player wagered on a tie and a tie did occur, the player receives an eight to one payoff. If, however, the player did not wager on a tie and a tie did occur, the player neither wins nor loses. In any case, upon the occurrence of a tie, all players who tied with the bank must pay a commission to the bank. In the preferred embodiment, the commission is ten percent of the wager. The commission is subtracted less frequently than in traditional baccarat or mini-baccarat where commission is charged on a winning wager by a player on the banker's hand. Logically, because the collection of the commission occurs less frequently, the commission percentage must be increased to maintain the level of profitability of the game. Because a tie between the banker and an individual player is statistically less frequent in occurrence, play of the game will be faster.

If the player's score exceeded the banker's score, the player receives a one to one payoff if he or she wagered on his or her own hand, and loses the wager otherwise.

If a player wagers on the banker's hand and the banker's hand loses, the player loses the wager.

This method of guaranteeing a profitability margin for the gaming establishment removes the drawbacks inherent in traditional baccarat and mini-baccarat. In addition, the cumbersome and confusing third card draw rules and the commission charged on a winning banker's hand wager are replaced by hands of three cards and a commission collected on the occurrence of a tie between the banker's hand and a player's hand.

Figure 3:
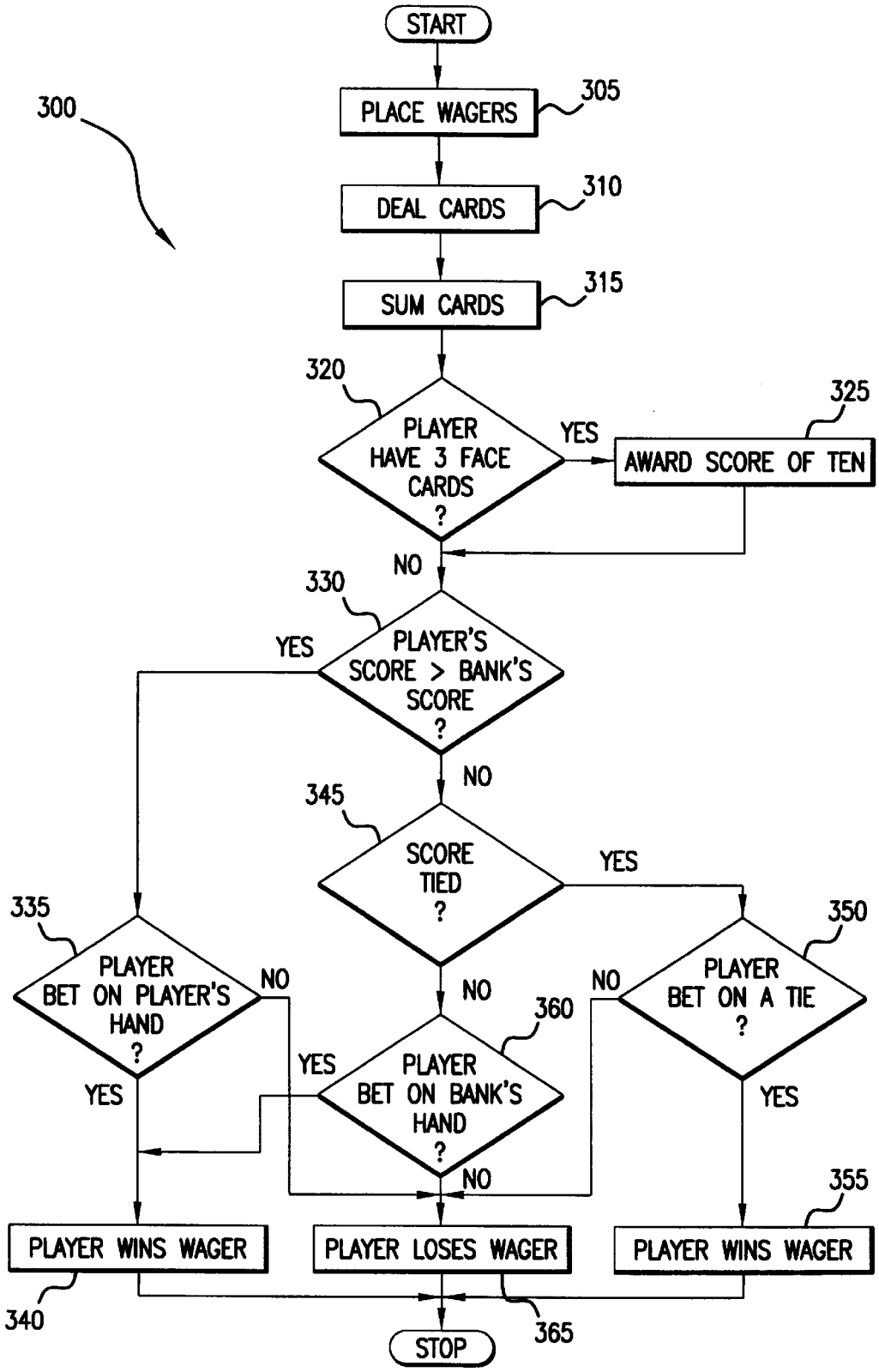
FIG. 3 is a flowchart of the card game method of play of the present invention.

FIG. 3 is a flowchart 300 of the card game method of play of the present invention. The game of starts in step 305 when the players place their wagers.

In step 310, three cards are dealt to each player's hand and three cards are dealt to the banker's hand.

In step 315, after the cards have been turned over, each hand is summed to obtain a banker's score and individual player's scores. A player is chosen for score comparison.

In step 320, if the player's hand contains any combination of three face cards, the method branches to step 325, where the player is awarded the highest point score of ten points.

In step 330, the player's score is compared to the banker's score. If the player's score is greater than the banker's score, the method branches to step 335, else it proceeds to step 345.

In step 335, if the player in question wagered on his or her own hand, the method proceeds to step 340 and he or she wins the wagered amount. Else, the method branches to step 365.

In step 345, if the player's score is tied with the banker's score, the method branches to step 350, else it proceeds to step 360.

In step 350, if the player did not wager on the tie, the method branches to step 365, and the player loses his or her wager. Else, the method proceeds to step 355, and the player wins his or her wager.

In step 360, at this point it has been determined that the banker's score is higher than the player's score, and it now must be determined whether the player wagered on the banker's hand. If the player wagered on the banker's hand, then the method branches to step 340 and the player wins his or her wager, else it branches to step 365 and the player loses the wager.

In a last step (not shown), if not all of the players have had their hands evaluated, the method branches back to step 315. Else, the hand of play is complete, and a new hand may commence.

In an alternative embodiment of the invention, at a point prior to the obtaining the banker's score and individual players' scores (step 315), each player is offered the opportunity to bank the game (wager) against all other players and the house/dealer. If the player wins his or her wager, he or she collects all of the losing wagers of the other players and the house/dealer. If the player loses his or her wager, he or she pays the winning wagers of all other players and the house/dealer. In one embodiment of the invention, when a select player is banking the game, that player receives the banker's hand and all other players receive a player hand. In an additional embodiment, when a player is banking the game, the house collects a 10% vigorish in the event of a tie between a player hand and the banker hand. In a further embodiment, when a player is banking the game, the house/dealer takes and pays all tie wages.

While the invention has been disclosed in detail above, the invention is not intended to be limited strictly to the invention as disclosed. It is evident that those skilled in the art may now make numerous uses and modifications of and departures from the specific embodiments described herein without departing from the inventive concepts.

What is claimed is:

1. A method of playing a card game between a banker and a plurality of players, comprising the steps of:

each player placing wagers on one of a banker's hand to win, or on a player's own hand to win, or on a tie between said player's hand and said banker's hand;

assigning a predetermined value to each card within a standard deck of cards, with an ace through "9" of each suit having values of one through nine respectively, and all "10"s and face cards of each suit having a value of zero;

dealing a player's hand to each player of said game and dealing a banker's hand;

adding up said assigned values in each of said player's hands and in said banker's hand to generate players' scores and a banker's score;

truncating the tens digit in each of said player's scores and in said banker's score to obtain a zero through nine value sum for each of said player's scores and said banker's score;

awarding a score of ten to a player's hand or said banker's hand if that player or banker hand contains a combination of any three face cards; and awarding a winning status to a player when said player's score exceeds said banker's score, awarding said winning status to said banker's score when said banker's score exceeds said individual player's score, and awarding a tie if a player's score equals the banker's score.

2. The method of playing the card game of claim 1, wherein up to nine players may play.

3. The method of playing the card game of claim 1, wherein the step of placing wagers comprises each player placing a wager on either said banker's hand to win or on said player's hand to win.

4. The method of playing the card game of claim 1, wherein said step of dealing further comprises dealing a three card player's hand and a three card banker's hand.

5. The method of playing the card game of claim 1, wherein when a tie occurs between said player's hand and said banker's hand, each of said players who wagered on either said player's hand or said banker's hand must pay a commission.

6. The method of playing the card game of claim 5, wherein said commission is ten percent of the wagered amount.

7. The method of playing the card game of claim 1, further comprising the step of offering a player the opportunity to bank the game against all other players and a dealer, whereby said player is responsible for monetary payment and collection of all wagers against all other players and the dealer.

8. The method of playing the card game of claim 1, further comprising the step of offering a player the opportunity to bank the game and when a player is banking the game, said player receiving the banker's hand and all other players receiving a player's hand.

9. The method of playing the card game of claim 1, further comprising the step of offering a player the opportunity to bank the game and when a player is banking the game, a dealer takes and pays all tie scores.

10. The method of playing the card game of claim 1, further comprising the step of offering a player the opportunity to bank the game and when a player is banking the game, the house collects a 10% vigorish in the event of a tie between a player hand and the banker hand.

* * * * *